US011312457B2

(12) United States Patent
Vaccaro et al.

(10) Patent No.: US 11,312,457 B2
(45) Date of Patent: Apr. 26, 2022

(54) FULL FACE DIVING MASK

(71) Applicant: SEACSUB S.P.A., S. Colombiano Certenoli (IT)

(72) Inventors: Gian Paolo Vaccaro, Rapallo (IT); Marinella Roggerone, Genoa (IT)

(73) Assignee: SEACSUB S.P.A., S. Colombiano Certenoli (IT)

( * ) Notice: Subject to any disclaimer, the term of this patent is extended or adjusted under 35 U.S.C. 154(b) by 123 days.

(21) Appl. No.: 16/642,513

(22) PCT Filed: Sep. 10, 2018

(86) PCT No.: PCT/IB2018/056886
§ 371 (c)(1),
(2) Date: Feb. 27, 2020

(87) PCT Pub. No.: WO2019/053577
PCT Pub. Date: Mar. 21, 2019

(65) Prior Publication Data

US 2020/0189700 A1 Jun. 18, 2020

(30) Foreign Application Priority Data

Sep. 15, 2017 (IT) ..... 102017000103760

(51) Int. Cl.
*B63C 11/16* (2006.01)
*B63C 11/18* (2006.01)

(52) U.S. Cl.
CPC ..... *B63C 11/16* (2013.01); *B63C 2011/182* (2013.01)

(58) Field of Classification Search
CPC ..... B63C 11/00; B63C 11/02; B63C 11/12; B63C 11/14; B63C 11/16; B63C 11/18;
(Continued)

(56) References Cited

U.S. PATENT DOCUMENTS

2016/0297505 A1* 10/2016 Caprice ..... B63C 11/16
2017/0096204 A1* 4/2017 Cucchia ..... B63C 11/16
(Continued)

FOREIGN PATENT DOCUMENTS

FR 2720050 A1 11/1995

OTHER PUBLICATIONS

International Search Report dated Nov. 28, 2018, corresponding to Application No. PCT/IB2018/056886.
(Continued)

*Primary Examiner* — Colin W Stuart
(74) *Attorney, Agent, or Firm* — Ladas & Parry LLP; Malcolm J. MacDonald

(57) ABSTRACT

A diving mask having a rigid frame with a front perimeter edge and a rear perimeter edge. The frame provides an upper portion and a lower portion connected by first and second lateral portions. The mask also includes a visor of a transparent material and fixed to the frame, and an inhalation duct, or snorkel. Inside the frame a face member made of a soft and flexible material is arranged in contact with the user's face. A partition member divides the volume between the visor and the face member in an upper chamber pneumatically connected to the inhalation duct, or snorkel, through an opening, and in a lower chamber arranged to house the nose and the mouth of the user. A discharge duct pneumatically connects the lower chamber with an exit mouth.

14 Claims, 4 Drawing Sheets

(58) Field of Classification Search
CPC ..... B63C 11/20; B63C 11/202; B63C 11/205; B63C 11/207; B63C 2011/165; B63C 2011/182
See application file for complete search history.

(56) References Cited

U.S. PATENT DOCUMENTS

| | | | | |
|---|---|---|---|---|
| 2018/0065719 | A1* | 3/2018 | Liao | B63C 11/16 |
| 2018/0134352 | A1* | 5/2018 | Armani | B63C 11/26 |
| 2018/0297676 | A1* | 10/2018 | Zheng | B63C 11/16 |
| 2018/0319471 | A1* | 11/2018 | Thomas | B63C 11/205 |
| 2019/0023366 | A1* | 1/2019 | Liao | B63C 11/16 |

OTHER PUBLICATIONS

International Search Report, dated Nov. 28, 2018, corresponding to International Application PCT/IB2018/056886.

* cited by examiner

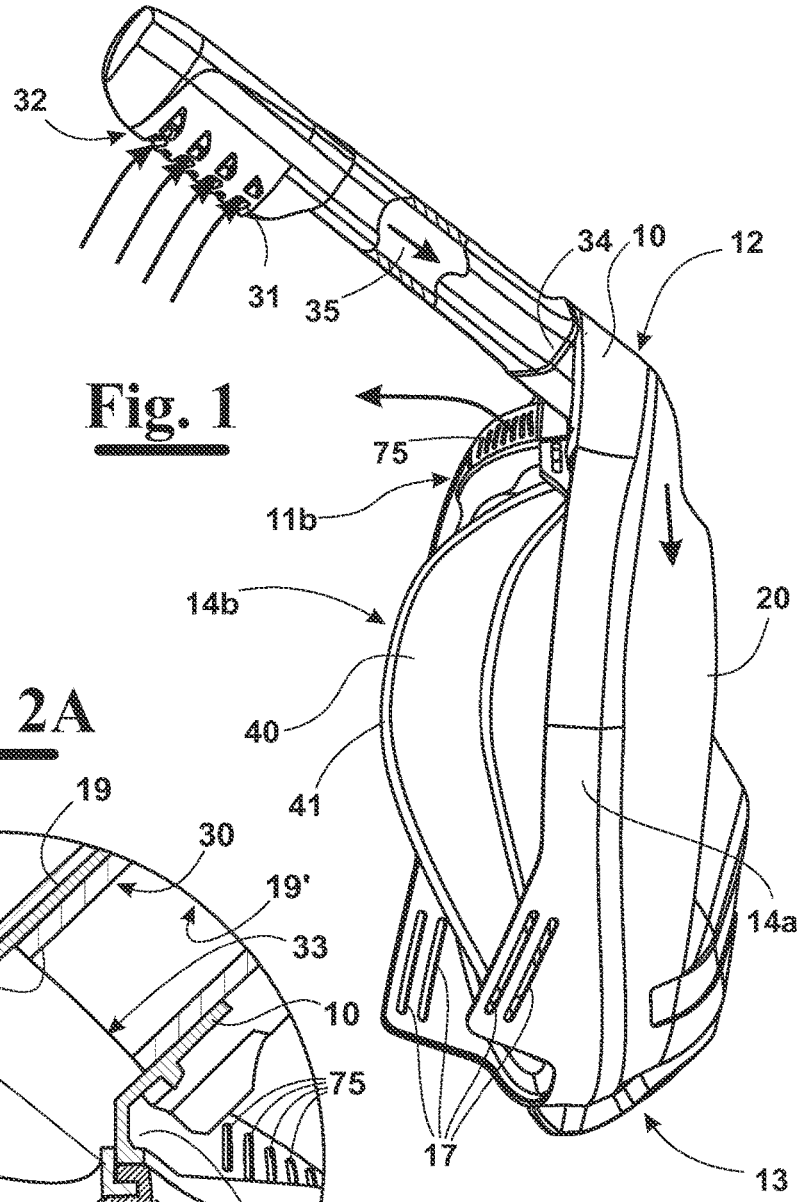
Fig. 1
Fig. 2A
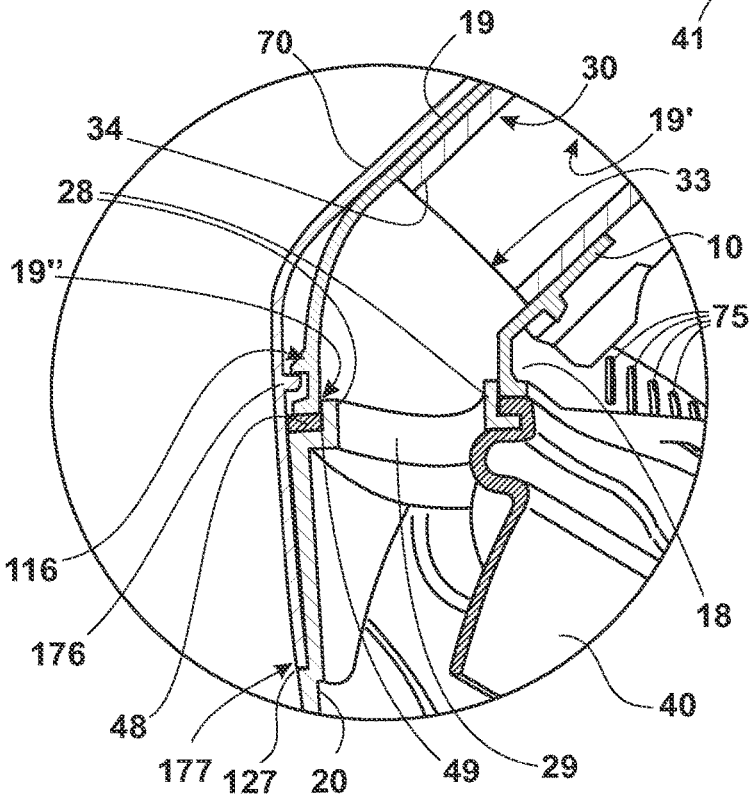

FULL FACE DIVING MASK

FIELD OF THE INVENTION

The present invention relates to the field of equipment for sport and recreation activities commonly practiced in water environment both amateurly and professionally.

In particular, the invention relates to a diving mask of the type commonly called "full face" diving mask that is improved with respect to similar products of prior art.

DESCRIPTION OF THE PRIOR ART

As known, the diving mask is an essential item of the equipment that is used to carry out underwater activities because it allows to see clearly underwater environment.

Normally, a diving mask of the type that is used for carrying out different activities in water environment, like swimming, snorkelling, apnea underwater, scuba diving, also into the depth of the water, comprises a more, or less, rigid frame, normally made of rubber, or silicone, to which a transparent member that is made of glass, or plastic, is fixed and that annuls the refraction phenomenon thus allowing the user to see the underwater environment. Generally, the part of the mask made of rubber covers the nose of the user, who breathes through a snorkel, or a mouthpiece.

Among the diving masks are known, in particular, the full face masks, that are so called because they cover the whole face of the user comprising the mouth.

A known type of full face diving mask that is used for snorkelling is, for example, described in WO2015/170013. More in detail, the full face mask that is described in this document provides an oblong-shaped rigid frame, to which a visor that is made of transparent material is fixed. A flexible face member is, furthermore, provided at which, in use, the user puts his face. The face member provides a partition member that is positioned, in use, on the user's nose, and that divides the volume between the visor and the face member in an upper chamber, at which, in use, the user's eyes are arranged, and a lower chamber, at which the nose and the mouth of the user are arranged. The upper chamber and the lower chamber communicates each other through one-way valves that are mounted on the partition member and that allow the inhaled air to pass from the upper chamber to the lower chamber, but not in the opposite direction. A snorkel is, furthermore, provided comprising an inlet channel for the inhaled air and two channels parallel to the inlet channel for the exit of the air breathed out. More in detail, the inlet channel for the entry of the air breathed in is pneumatically connected with the above mentioned upper chamber, whilst the 2 outlet channels for the air breathed out communicates with the lower chamber through an exit duct that is provided in the rigid frame.

The mask, furthermore, comprises a purge valve to allow the water, in case it enters into the mask during its use, to evacuate outside.

However, the full face mask described in WO2015/170013 have many drawbacks. Firstly, the pathway that the flow of air breathed out by the user has to travel in order to reach the outlet channels and to be, then, discharged outside, is very long, because further to the outlet channel provided in the rigid frame, the flow of air breathed out has to run through all the length of the snorkel in order to flow out at the top of the same. Therefore, in order to overcome both the concentrated and distributed pressure drops along the pathway and to be sure that the air breathed out flows out in the surrounding environment, the user has to strongly breathe out, thus consuming a lot of energy. Therefore, the user's breath cycle, which is the alternation of inspiration and expiration, cannot be natural.

Another drawback of the full face mask described in WO2015/170013 is that the snorkel and the mask are difficult to manufacture and, therefore, have high production costs.

Another example of full face mask that is very similar to the previous one is described in FR2720050. In this case, the difference with the full face mask described in WO2015/170013, is that the frame is made of flexible material, with the further disadvantage with respect to those above highlighted that, the duct, into which, in use, the air breathed out by the user passes in order to pass from the lower chamber to the snorkel, is subject to deformation and, therefore, is not able to guarantee that the exhaled air can regularly flow out.

In order to try to overcome the above disclosed disadvantages, solutions of full face masks have been proposed in which the snorkel is used only for the inlet of the flow of inhaled air, and in which the air breathed out by the user exits through outlets that are made at the lateral portions of the frame, approximately at the height of the user's eyes.

However, these last full face masks have the disadvantage that, since, during the use, the outlets through which the air breathed out exits, are immersed in the water, the flow of air breathed out exiting through the outlets produces air bubbles in the water near the user's ear, thus, disturbing the user with their noises during the use of the mask.

In addition to the above, the air bubbles in the water can obstruct the view of marine environment, because they occupy the area in front of the user's eyes. Another disadvantage of these full face masks is that the outlet of flow of air exhaled by the user, through the outlets, is obstructed by the body of water and, therefore, the user has difficulty in breathing.

SUMMARY OF THE INVENTION

It is therefore an object of the present invention to provide a diving mask, in particular a "full face" diving mask, that is able to overcome the above disadvantages of analogous products of prior art.

It is, in particular, an object of the present invention to provide a diving mask that is able to assure that the user can breathe, in particular that he can breathe out, in a completely natural way during the use of the mask.

It is another object of the present invention to provide a diving mask that have production costs lower than similar items of prior art.

These and other objects are achieved by the diving mask, in particular a full face diving mask, according to the invention, comprising:

- a rigid frame having a front perimeter edge and a rear perimeter edge, said rigid frame being provided with an upper portion, a lower portion, and a first and a second lateral portion arranged to connect said upper portion to said lower portion;
- a visor made of a transparent material and engaged to said rigid frame, said visor being configured in such a way to protrude, in use, beyond said front perimeter edge of said rigid frame;
- an inhalation duct, or snorkel, which is integral, in use, to said upper portion of said rigid frame, said inhalation duct being provided with a longitudinal passage;
- a face member made of a flexible material, and advantageously soft, that is engaged inside of said rigid frame and having a rear edge configured to be arranged, in use, in contact with the user's face, said face member comprising a partition member configured to divide the volume between said visor and said face member in an upper chamber pneumatically connected to said inhalation duct, or snorkel, through at least an opening, and a lower chamber arranged to house, in use, the nose and the mouth of the user;

at least a one-way valve arranged to pneumatically connect said upper chamber with said lower chamber and configured to allow the air to pass from said upper chamber to said lower chamber during the user's inspiration, and to impede, instead, the air to pass in the opposite direction, i.e. from said lower chamber to said upper chamber during the user's expiration;

at least an exit mouth for the exit of the air breathed out by the user;

at least a discharge duct configured to pneumatically connect said lower chamber with said, or each, exit mouth;

whose main characteristic is that said, or each, exit mouth is provided at said rear perimeter edge of said upper portion of said rigid frame.

The particular solution according to the present invention allows that the exiting air flow moves away from the rear side of the mask, in a position that is far from the ears of the user, who, therefore, is not disturbed by the noise produced by the air bubbles in water. Furthermore, the present invention allows to avoid that the air bubbles formed in the body of water can obstruct the user's view because they are produced far from the area in front of the user's eyes. A further advantage of the present invention is to assure that the user can breathe in a completely natural way, because, during inspiration he has all the cross section of the snorkel available to breathe in the air flow, and during the expiration, the flow of air breathed out is not obstructed by the body of water in which the user is immersed during the use of the mask. In addition to the above, the completely natural expiration is also guaranteed by the fact that during the expiration, he does not need to strongly breathe out the air flow, because the exit pathway is shorter than other solutions of prior art, in particular than the solution described in WO2015/170013.

Further features of the present invention and relative embodiments are set out in the dependent claims.

In particular, the exit mouths are configured in such a way to be, in use, directed substantially parallel to the surface of water, in which the user is arranged. This characteristic allows to simplify to breath out the air, in particular with respect to other solutions, which provide the exit mouths of air close to the ears.

Advantageously, the lower chamber of the face member provides at least an opening for the exit of the air breathed out by the user. More in particular, the, or each, opening is pneumatically connected with the, or each, exit mouth through the above mentioned discharge duct.

Preferably, the rigid frame, at the above mentioned upper portion, provides a deflector body provided with said, or each, exit mouth and configured to deviate the flow of air breathed out by the user from a stream direction to a discharge direction inclined by a predetermined angle with respect to the stream direction.

Advantageously, the deflector body comprises a first and at least a second wall inclined one with respect to the other. More in detail, the, or each, exit mouth is provided at the second wall of deflector body.

In particular, the above mentioned discharge direction is substantially orthogonal to the above mentioned second wall of the deflector body.

Preferably, the, or each, discharge duct is made in the visor.

In a preferred embodiment of the invention, the deflector body is configured to removably engage a main body of the rigid frame. More in detail, the main body of the rigid frame provides an exit hole pneumatically connected with said discharge duct and with said, or each, exit mouth through the deflector body. More in particular, the above mentioned deflector body is configured to deviate the flow of air breathed out by the user and to direct the same towards the, or each, exit mouth, once it has passed through the above mentioned exit hole.

Advantageously, the visor and the rigid frame provide respective engagement portions configured to mutually engage and to tighten, in use, the face member between them. More precisely, the visor, the rigid frame and the face member, at the above mentioned engagement portions, provide respective engagement holes arranged, in use, coaxially one with respect to the other.

In particular, the visor provides an engagement edge, which laterally delimits each connection hole of which is provided. Each engagement edge is configured to engage, in use, in a respective hole of the rigid frame, in particular, in an inlet hole, and in each exit hole, with a portion of the face member arranged between them, in such a way to carry out a firm engagement of the face member of the rigid frame. Therefore, in use, each exit hole of the rigid frame is coaxial to a hole of the face member and to a hole of the visor. Analogously, the inlet hole of the rigid frame is coaxial to a hole of the face member and to a hole of the visor.

In particular, the exit hole of rigid frame is associated to a deformable membrane configured to move from a closing configuration of the exit hole to an opening configuration of the exit hole same, to allow the air breathed out to flow out the discharge duct towards the, or each, exit mouth, and to impede, instead, the air, or other fluids, to move in the opposite direction that means inside of the discharge duct.

In a preferred embodiment of the invention, at the upper portion of rigid frame, at least a first and a second exit mouth are provided positioned at opposite sides with respect to the inhalation duct, or snorkel.

In particular, the deflector body provides a first side arranged, in use, parallel to the upper portion of rigid frame and a second side arranged, in use, parallel to the rear edge of the rigid frame. More in particular, the, or each, exit mouth is provided at the second side.

Advantageously, the deflector body and the main body of rigid frame provide mutual engagement members, in particular mutual snap fit engagement members, configured to removably move from an engagement configuration to a disengagement configuration. In this way it is possible to easily disengage the deflector body from the main body of the rigid frame in order to reach, in particular, the above mentioned membrane and to provide, in case, to clean, or to replace the same.

BRIEF DESCRIPTION OF THE DRAWINGS

The invention will now be shown with the following description of its exemplary embodiments, exemplifying but not limitative, with reference to the attached drawings in which:

FIG. 1 diagrammatically shows a side elevation perspective view of a diving mask according to the invention;

FIG. 2A diagrammatically shows a longitudinal section of the diving mask of FIG. 1 in the engagement zone between snorkel, frame and visor;

DETAILED DESCRIPTION OF SOME EXEMPLARY EMBODIMENTS OF THE INVENTION

Figure 2B:
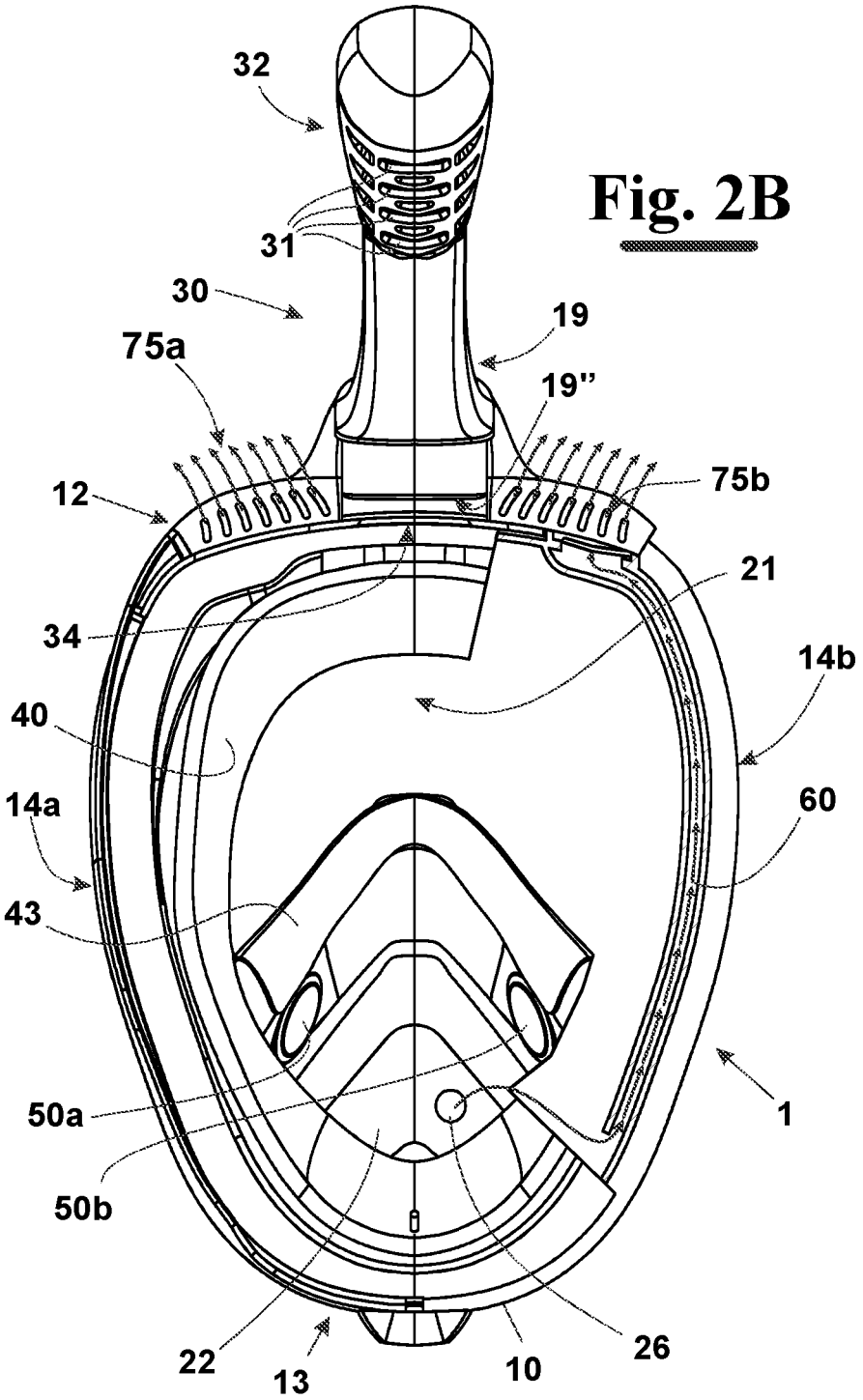
FIG. 2B shows a rear view of the diving mask of FIG. 1.

As diagrammatically shown in FIG. 1, a diving mask 1, according to the invention, in particular of the type known as "full face" diving mask, comprises a rigid frame 10, substantially oblong-shaped, having a front perimeter edge 11*a* and a rear perimeter edge 11*b*. The rigid frame 10 provides, in particular, an upper portion 12 and a lower portion 13 connected by a first and a second lateral portion 14*a* and 14*b*. The mask 1 provides, furthermore, a visor 20 made of a transparent material and fixed to the rigid frame 10. In particular, the visor 20 is configured in such a way to protrude, in use, beyond the front edge 11*a* of the rigid frame 10. The mask 1 provides, furthermore, an inhalation duct, or snorkel, 30 which is integral, in use, to the upper portion 12 of rigid frame 10. More precisely, the inhalation duct 30 provides a longitudinal passage 35 through which, in use, a flow of air breathed in by the user flows. Inside of the rigid frame 10 a face member 40, which is made of a soft and flexible material, is fixed, and which has a rear edge 41 configured to be arranged, in use, in contact with the user's face. The face member 40 comprises, in particular, a partition member 43 configured to divide the volume between the visor 20 and the face member 40, in an upper chamber 21, which is pneumatically connected to the longitudinal passage 35 of the inhalation duct, or snorkel 30, and in a lower chamber 22, which is arranged to house, in use, the nose and the mouth of the user. In particular, the snorkel 30 provides at least an inlet opening 31, at a first extremity portion 32 through which the air enters into the longitudinal passage 35, and an outlet opening 33 at a second extremity portion 34 opposite to the first extremity portion 32. More in particular, the second extremity portion 34 of snorkel 30 is arranged to engage, in use, a joint portion 19, advantageously tubular-shaped. For example, the extremity portion 34 of the snorkel 30 can be engaged to the rigid frame 10 by introducing the same in the joint portion 19 through a hole 19'. The joint portion 19 of rigid frame 10 can be, furthermore, advantageously provided of a connection hole 19" through which the flow of air breathed in by the user passes from the longitudinal cavity 35 of snorkel 30 in the upper chamber 21 of visor 20 through the above mentioned outlet opening 33. The upper chamber 21 and the lower chamber 22 are pneumatically connected one another through at least a one-way valve 50, for example 2 one-way valves 50*a* and 50*b*. More precisely, the, or each, one-way valve 50 is configured to allow the air to pass from the upper chamber 21 to the lower chamber 22 during the user's inspiration, and to impede, instead, to move in the opposite direction, i.e. from the lower chamber 22 to the upper chamber 21 during the user's expiration. At least an exit mouth 75 is furthermore provided through which the air breathed out by the user moves away from the mask 1 after having passed through a discharge duct 60. The latter is configured, in particular, to pneumatically connect the above mentioned lower chamber 22 with the, or each, exit mouth 75. In the preferred embodiment that is shown, for example, in FIG. 2B, the discharge duct 60 is provided at the visor 20 and is pneumatically connected with the lower chamber 22 through at least an aperture 26. In particular, a first and a second discharge duct 60 are provided in the visor 20 at the opposite sides of the mask 1. This, furthermore, comprises a purge valve 85 to allow the water to exit in case it enters into the mask 1 during the use of the same. The rigid frame 10, furthermore, provides holes 17 for engaging a head strap, not shown in the figure for reasons of simplicity, in order to fasten the diving mask 1 to the user's head during working conditions.

According to the invention, the, or each, exit mouth 75 is positioned at the upper portion 12 of rigid frame, and, more precisely, at the rear perimeter edge 11*b* of the same.

In the embodiment shown in particular in the figures from 3 to 5, the rigid frame 10, at the above mentioned upper portion 12, provides a deflector body 70 provided of the, or each, exit mouth 75. More precisely, the deflector body 70 is configured to deviate the flow of air breathed out by the user from a stream direction 114 to a discharge direction 115 inclined by a predetermined angle with respect to the stream direction 114. In particular, just as an indication, in order to help reader to correctly understand the above mentioned feature of the invention, we can say that the stream direction 114 is substantially parallel to the coronal plane of the user, whereas the discharge direction 115 is substantially parallel to the sagittal plane of the user.

The deflector body 70 can be, for example, essentially constituted of a first wall 71 and at least a second wall inclined one with respect to the other. More in particular, the first wall 71 is arranged, in use, in front of the exit hole 15 of the rigid frame 10. The second wall 72 provides the, or each, exit mouth 75 whereby it is substantially orthogonal to the discharge direction 115 along which the flow of air breathed out exits the mask 1. In the embodiments of the invention that is shown, as an example, in the figures from 1 to 5, a first group 75*a* of exit mouths 75 and a second group 75*b* of exit mouths are provided arranged at opposite sides with respect to the snorkel 30.

The deflector body 70 can be integrated in the rigid frame 10, i.e. the two components can be made in a single piece, for example can be made by moulding of plastic material.

In a preferred embodiment of the invention, the deflector body 70 is a body independent from the rigid frame 10 and configured to removably engage a main body 16 of the rigid frame 10. More in detail, the main body 16 of rigid frame 10 provides an exit hole 15 pneumatically connected to the discharge duct 60 and to the, or each, exit mouth 75 by means of the deflector body 70. Therefore, the above mentioned deflector body 70 is configured to deviate the flow of air breathed out by the user and to direct it towards the, or each, exit mouth 75 for leaving the mask 1 along the discharge direction 115, once it has passed through the above mentioned exit hole 15 along the stream direction 114.

Figure 3:
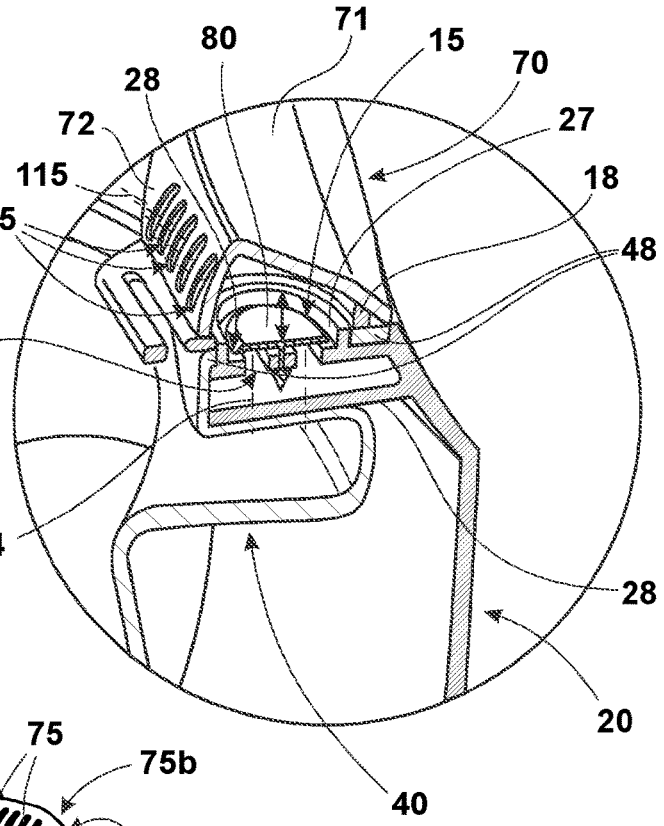
FIG. 3 shows a cross section of a portion of a diving mask, according to an embodiment of the invention, in order to highlight some constructive components.
Figure 4:
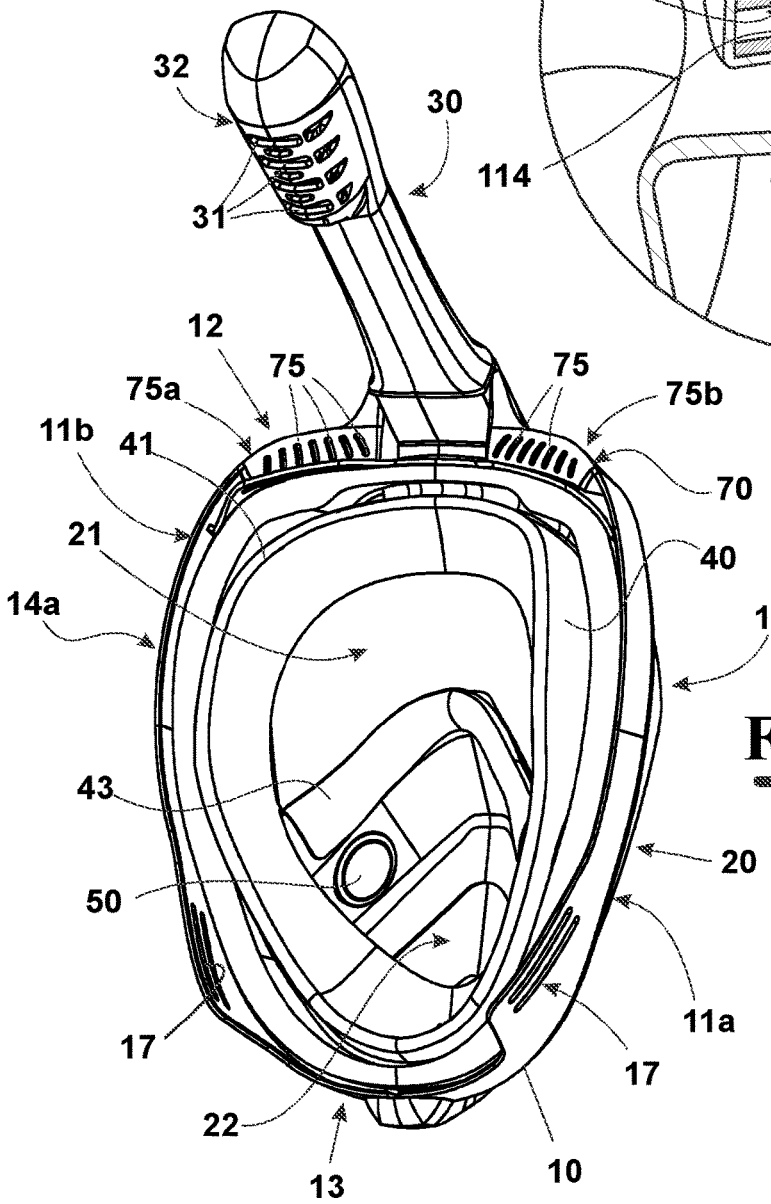
FIG. 4 shows a rear perspective view of the mask of FIG. 2B.
Figure 5:
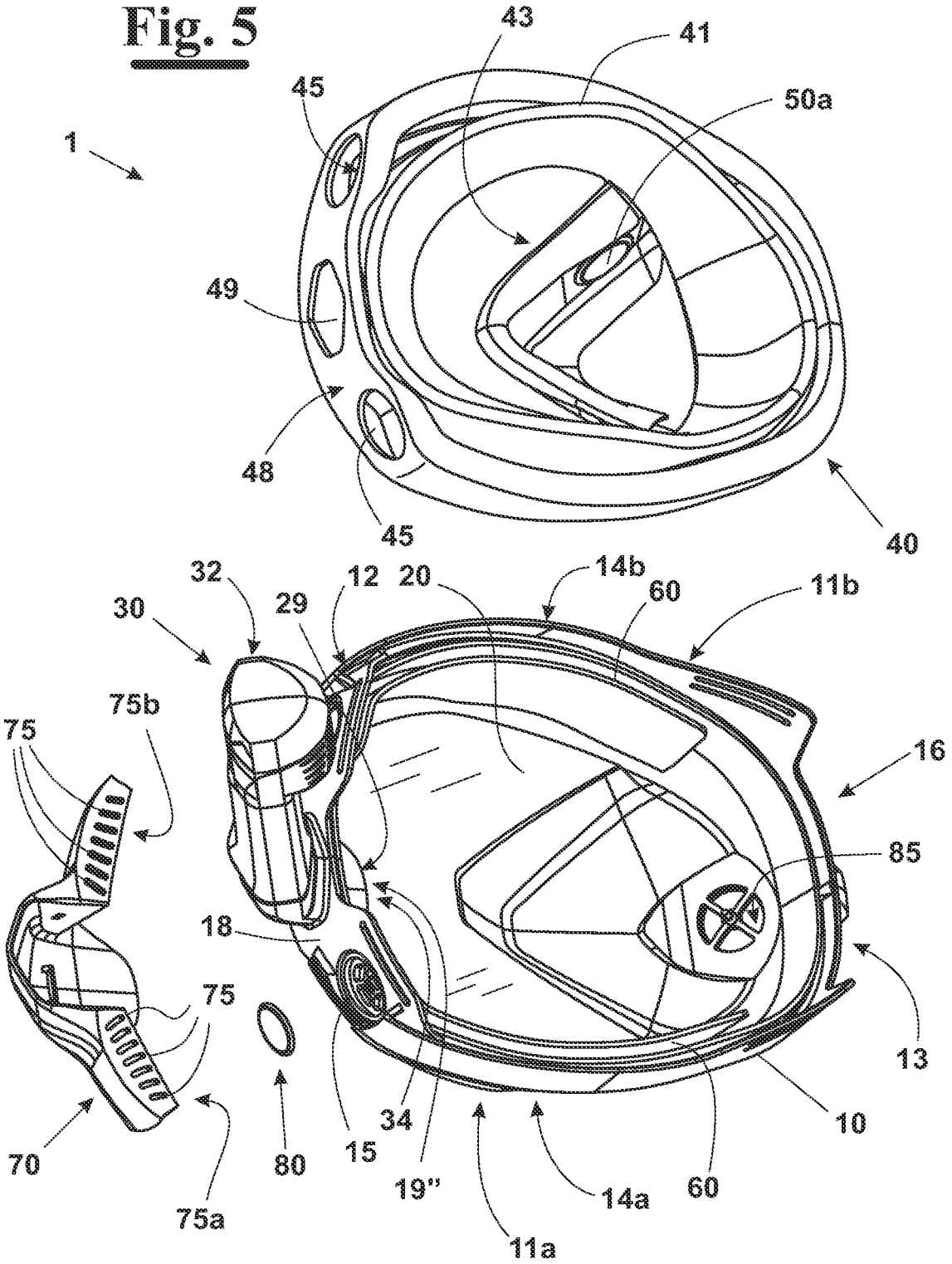
FIG. 5 shows an exploded perspective view of the main components of another embodiment of the diving mask according to the invention.

In particular, the visor 20 and the rigid frame 10 can provide respective tightening portions 28 and 18 configured to mutually engage and tighten between them, in use, an engagement portion 48 of face member 40 (see FIGS. 2A and 3). Preferably, the tightening portion 18 of rigid frame 10 and the engagement portion 48 of face member 40 are substantially flat-shaped. More precisely, the visor 20, at the tightening portion 28, and the face member 40, at the respective engagement portion 48, provide respective connection holes 25 and 45 (see FIGS. 3 and 5) arranged, in use, coaxially to the exit hole 15 provided at the tightening portion 18 of the rigid frame 10. Similarly to what above described for the connection holes, also at the inlet hole 19", the visor 20 and the face member 40 provides respective holes coaxial to the inlet hole 19" of rigid frame 10. In FIG. 5, in particular, holes 45 and 49 are shown that are made at the engagement portion 48 of face member 40. More in particular, once the mask has been assembled, the, or each, hole 45 of face member 40 is positioned at a respective hole 25 of visor 20 and of a respective hole 15 of rigid frame 10. Analogously, the hole 49 of face member 40 is arranged at hole 19" of the frame 10 and at hole 29 provided in the visor 20 (FIG. 2A).

In particular, visor 20 can provide an engagement edge 27, which laterally delimits each connection hole 25 of which is provided. Each engagement edge 27 is configured to engage, in use, in a respective exit hole 15, or in a respective inlet hole 19" of rigid frame 10, with a portion of face member 40 arranged between them, in such a way to provide a firm engagement of face member 40 to rigid frame 10.

In an advantageous embodiment of the invention, the exit hole 15 of rigid frame 10 is associated to a deformable membrane 80 configured to move from a closing configuration of the exit hole 15, to an opening configuration, in such a way to allow the breathed out air to flow out through discharge duct 60 towards the, or each, exit mouth 75, and to impede, instead, the passage of air, or water, in the opposite direction.

The deflector body 70 and the main body 16 of rigid frame 10 can provide respective mutual engagement members, for example mutual snap fit engagement members configured to reversibly move from an engagement configuration to a disengagement configuration, not shown in figure for reason of simplicity. More in particular, in the exemplary embodiment of FIG. 2A, a solution is diagrammatically shown that allows to engage the rigid frame 10 to visor 20 and to deflector body 70. Advantageously, the deflector body 70 can provide engagement portions 176 and 177 arranged to respectively engage an engagement member 127 provided in the visor 20, and an engagement member 116 of the rigid frame 10. For example, the deflector body 70 can provide a protruding tooth 176 facing, in use, the rigid frame 10, which provides, this too, a protruding engagement member 116. More in particular, in use, the edge 177 of deflector body 70 is arranged at a "step" 127 made at the external surface of visor 20. Advantageously, the deflector body 70 can be, therefore, elastically deformed in such a way that the tooth 176 is forced to abut against the tooth 116, and that, therefore, the deflector body 70 is engaged between the two above disclosed engagement members 116 and 127.

In this way it is possible to easily disengage the deflector body from the main body of rigid frame in order to reach, in particular, the above mentioned membrane and to provide, in case, to clean, or the replacement of the same.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A diving mask comprising:

a rigid frame having a front perimeter edge and a rear perimeter edge, said rigid frame provided with an upper portion, a lower portion, and a first and a second lateral portion arranged to connect said upper portion to said lower portion;

a visor made of a transparent material and engaged to said rigid frame, said visor being configured in such a way to protrude beyond said front perimeter edge of said rigid frame;

an inhalation duct, or snorkel, integral to said upper portion of said rigid frame, said inhalation duct or snorkel being provided with a longitudinal passage;

a face member made of a flexible material configured to be engaged inside of said rigid frame, and having a rear edge configured to be arranged in contact with a user's face, said face member comprising a partition member configured to divide a volume between said visor and said face member in an upper chamber pneumatically connected to said inhalation duct, or snorkel, through an opening, and in a lower chamber arranged to house the nose and the mouth of the user;

a one-way valve arranged to pneumatically connect said upper chamber with said lower chamber and configured to allow air to pass from said upper chamber to said lower chamber during an inspiration of the user, and to impede, instead, the air to pass in the opposite direction, that means from said lower chamber to said upper chamber during an expiration of the user;

an exit mouth for the exit of the air breathed out by the user;

a discharge duct configured to pneumatically connect said lower chamber with said exit mouth;

wherein said exit mouth is provided at said rear perimeter edge of said upper portion of said rigid frame.

2. The diving mask, according to claim 1, wherein said discharge duct is provided in said visor.

3. The diving mask, according to claim 2, wherein said face member provides an outlet opening pneumatically connected with said exit mouth through said discharge duct.

4. The diving mask, according to claim 1, wherein an exit hole is associated with a deformable membrane configured to move from a closing configuration of said exit hole to an opening configuration of the exit hole, in order to allow the air breathed out to flow out said discharge duct, and to impede, instead, air, or water, to flow in the opposite direction into the discharge duct.

5. The diving mask, according to claim 1, wherein, at said upper portion, first and second exit mouths are arranged at opposite sides with respect to said inhalation duct, or snorkel.

6. The diving mask, according to claim 1, wherein said rigid frame, at said upper portion, provides a deflector body provided with said exit mouth, and configured to deviate the flow of air breathed out by the user from a stream direction to a discharge direction inclined by a predetermined angle with respect to said stream direction.

7. The diving mask, according to claim 6, wherein said deflector body is configured to removably engage a main body of said rigid frame.

8. The diving mask, according to claim 7, wherein said main body of said rigid frame provides an exit hole pneumatically connected with said lower chamber through said discharge duct and with said exit mouth through said deflector body.

9. The diving mask, according to claim 6, wherein said deflector body provides a first wall arranged in front of an exit hole of said rigid frame, and a second wall orthogonal to said discharge direction, said exit mouth being provided at said second wall.

10. The diving mask, according to claim 6, wherein said deflector body and said rigid frame provide mutual engagement members configured to removably move from a mutual engagement configuration to a disengagement configuration.

11. The diving mask, according to claim 6, wherein said deflector body provides engagement portions configured to engage an engagement member of said visor, and an engagement member of said rigid frame.

12. The diving mask, according to claim 1, wherein said visor and said rigid frame provide tightening portions configured to mutually engage and to tighten between them an engagement portion of said face member.

13. The diving mask, according to claim 12, wherein said tightening portion of said rigid frame and said engagement portion of said face member are flat-shaped.

14. The diving mask, according to claim 12, wherein said visor, at said tightening portion, and said face member, at said engagement portion, provide a connection hole arranged coaxially to an exit hole provided at said tightening portion of said visor.

* * * * *